US010094384B2

(12) United States Patent
McGinn et al.

(10) Patent No.: US 10,094,384 B2
(45) Date of Patent: Oct. 9, 2018

(54) RADIAL IMPELLER AND CASING FOR CENTRIFUGAL PUMP

(71) Applicant: McFinn Technologies, Kenosha, WI (US)

(72) Inventors: John J McGinn, Kenosha, WI (US); Leroy S Finnigan, Pleasant Prairie, WI (US)

(73) Assignee: MCFINN TECHNOLOGIES, LLC, Kenosha, WI (US)

( * ) Notice: Subject to any disclaimer, the term of this patent is extended or adjusted under 35 U.S.C. 154(b) by 724 days.

(21) Appl. No.: 14/603,566

(22) Filed: Jan. 23, 2015

(65) Prior Publication Data

US 2015/0211521 A1 Jul. 30, 2015

Related U.S. Application Data

(60) Provisional application No. 61/931,369, filed on Jan. 24, 2014.

(51) Int. Cl.
*F04D 29/42* (2006.01)
*F04D 7/04* (2006.01)
*F04D 29/22* (2006.01)

(52) U.S. Cl.
CPC ..... *F04D 7/04* (2013.01); *F04D 29/2216* (2013.01); *F04D 29/426* (2013.01)

(58) Field of Classification Search
CPC ..... F04D 7/04; F04D 7/045; F04D 29/2216; F04D 29/2288; F04D 1/04
See application file for complete search history.

(56) References Cited

U.S. PATENT DOCUMENTS 4,540,528 A 9/1985 Haegeman
4,770,604 A * 9/1988 Luthi ..... F04D 7/04 415/143
6,619,910 B1 * 9/2003 Burgess ..... F04D 29/2277 415/143

(Continued)

FOREIGN PATENT DOCUMENTS

EP 0 131 326 A2 1/1985
EP 1 584 820 A1 10/2005

(Continued)

OTHER PUBLICATIONS

European Patent Office, Communication with partial European search report, in application No. 15152319.8, dated Jun. 22, 2015 (7 pages).

(Continued)

*Primary Examiner* — Justin Seabe
(74) *Attorney, Agent, or Firm* — McAndrews, Held & Malloy, Ltd.

(57) ABSTRACT

An improved impeller and a casing for a centrifugal pump are disclosed. The impeller comprises vanes which sweep an arc around an impeller axis to provide a smooth path past the impeller and through the pump. The casing is constructed to allow maximum flow rate at the eye of the impeller then shrink the flow channel to reduce internal recirculation promote efficiency, further limiting the effect of damaging forces. The impeller is suited for use in pumps in which a high head is required and in which only low shear forces must be applied to the fluid moving through the pump.

16 Claims, 8 Drawing Sheets

(56) References Cited

U.S. PATENT DOCUMENTS

| | | | | |
|---|---|---|---|---|
| 2002/0098090 | A1 | 7/2002 | Muhs | |
| 2003/0007871 | A1 | 1/2003 | McGinn | |
| 2005/0019512 | A1 | 5/2005 | Arnold | |
| 2005/0095124 | A1 | 5/2005 | Arnold et al. | |
| 2007/0172345 | A1 | 7/2007 | Stahle | |
| 2007/0201977 | A1 | 8/2007 | Clarence et al. | |
| 2009/0016937 | A1 | 7/2009 | Ilves | |
| 2009/0169374 | A1 | 7/2009 | Ilves et al. | |
| 2010/0215504 | A1 | 8/2010 | Stahle | |
| 2013/0129524 | A1* | 5/2013 | Sargent | F04D 25/04 416/243 |
| 2014/0119922 | A1* | 5/2014 | Nakano | F04D 29/30 416/189 |

FOREIGN PATENT DOCUMENTS

| | | | |
|---|---|---|---|
| EP | 1 906 025 | A1 | 4/2008 |
| WO | 2005/100796 | A1 | 10/2005 |

OTHER PUBLICATIONS

European Patent Office, Communication with Extended European Search Report, in Application No. 15152319.8, dated Nov. 27, 2015 (19 pages).

* cited by examiner

RADIAL IMPELLER AND CASING FOR CENTRIFUGAL PUMP

CROSS REFERENCE TO RELATED APPLICATIONS

This patent application makes reference to, claims priority to, and claims benefit from the U.S. Provisional Patent Application Ser. No. 61/931,369, filed Jan. 24, 2014. The above-identified application is hereby incorporated herein by reference in its entirety.

FIELD OF THE INVENTION

The present invention generally relates to centrifugal pumps, such as, for example, centrifugal pumps having impellers of radial, Francis vane, mixed flow, and axial flow design. More specifically, the present invention relates to an impeller and casing for centrifugal pumps that may produce a high head output and high efficiency, while also being capable of pumping shear sensitive liquids or liquids having suspended solids without applying damaging forces to the liquid or the solids.

BACKGROUND OF THE INVENTION

Conventional centrifugal pumps include an impeller that rotates within a cavity in the body of the pump. Fluid entering from an inlet in the cavity typically flows toward the impeller and near to the impeller's center of its rotation. Further, the rotation of the impeller typically forces fluid to flow radially outward toward an outlet of the cavity that is often at a location that is radially adjacent to the impeller.

Producing high head output by centrifugal pumps often requires that the impeller be rotated at accelerated speeds. However, such accelerated speeds are typically associated with the generation of a relatively significant shearing force that is applied to the fluid that is flowing through the pump. Yet such shearing forces may be unacceptable for at least certain types of fluids and/or solids that are passing through the pump. For example, food processing systems, pharmaceutical processing systems, and clay slurries, are examples of applications in which a high shearing force may be unacceptable due to the potential damage that such shearing forces may cause to the structure of the fluid and/or the solids within the fluid. Thus, in applications in which the fluid or solids flowing through the pump should not be subjected to such shearing forces, typically the impeller may be operated at a low pump speed and have a low head output. Moreover, to avoid and/or minimize the generation of such shearing forces, the total head generation capability of the centrifugal pumps may be limited or centrifugal pumps may not be used in such applications.

Additionally, low shear centrifugal pump designs, particularly food grade pumps, have relatively lower efficiencies than standard industrial centrifugal pumps. Thus, low shear centrifugal pump designs often result in pumps that have more internal recirculation of fluids and/or solids within the pump and have higher power requirements.

BRIEF SUMMARY OF THE INVENTION

The disadvantages and limitations of known impeller centrifugal pumps can be overcome by providing an impeller that subjects the fluid moving through the pump to lower shear forces than known centrifugal pump impellers.

In particular, the vanes of the impeller, limit the forces applied to fluid flowing past the impeller. The vanes are configured to have a circumferential width and axial length that guides the fluid along a smooth path thereby avoiding the shearing forces associated with abrupt changes in the flow path of a fluid. Also, the longer fluid path reduces both the rate of acceleration and the intensity of jerk acceleration.

The top of each vane of the impeller can have a wide cross section which creates an extended slip path from the high pressure side of the vane to the low pressure side of the vane. This extended slip path improves the efficiency of the impeller by reducing the amount of fluid that can move from the high pressure side of the vane to the low pressure side of the vane within the pump. Reducing fluid recirculation within the pump from the high pressure side of the vane to the low pressure side of the vane reduces the amount of shearing forces felt by the fluid. There is also a circular shroud as part of the bottom of the impeller. This shroud prevents recirculation from the high pressure side of the vane to the low pressure side. The rotation of the shroud imparts energy to fluid rotating within the volute and improves efficiency.

In another aspect, disadvantages and limitations of known impeller centrifugal pumps can be overcome by providing a circular or volute casing that has a recess for part of the impeller that further restricts internal recirculation, and improves efficiency, by narrowing the flow chamber within the pump from the impeller eye to the periphery. The narrow flow chamber also increases priming capability.

In another aspect, the rate of fluid acceleration and the incidence of abrupt changes in direction that can manifest as high pressure losses can be reduced resulting in higher inlet pressure requirements. Reduction of acceleration forces and reduction of abrupt changes in direction inherently results in a reduction of inlet pressure requirements. Further to the reduction of inlet pressure, the hub of the impeller can be diametrically tapered from maximum hub diameter at the center of the impeller height to a diameter equivalent to the impeller blade width.

In yet another aspect, the outlet port of the casing can be positioned such that the aft location of the internal diameter of the port is aligned with the back of the impeller shroud to ensure an efficient flow rate as the fluid translates from the axial center front to the impeller to the rearward periphery of the same.

Test results show that, when pumps employing the claimed impeller and casing are used in certain dairy processing applications, the acid degree value of the milk does not increase as a result of pumping. An increase in acid degree value typically serves as an indicator that the fat globules in the milk have been damaged due to mechanical shearing. Accordingly, the claimed impeller and casing cause less damage to the milk. This advantageous result would also benefit other applications beside dairy processing systems, such as food processing systems, pharmaceutical processing systems, and clay slurries.

These and other objects and advantages of the impeller and/or casing described in this disclosure will be understood from the following description and drawings of exemplary embodiments of an impeller and casing.

Figure 1:
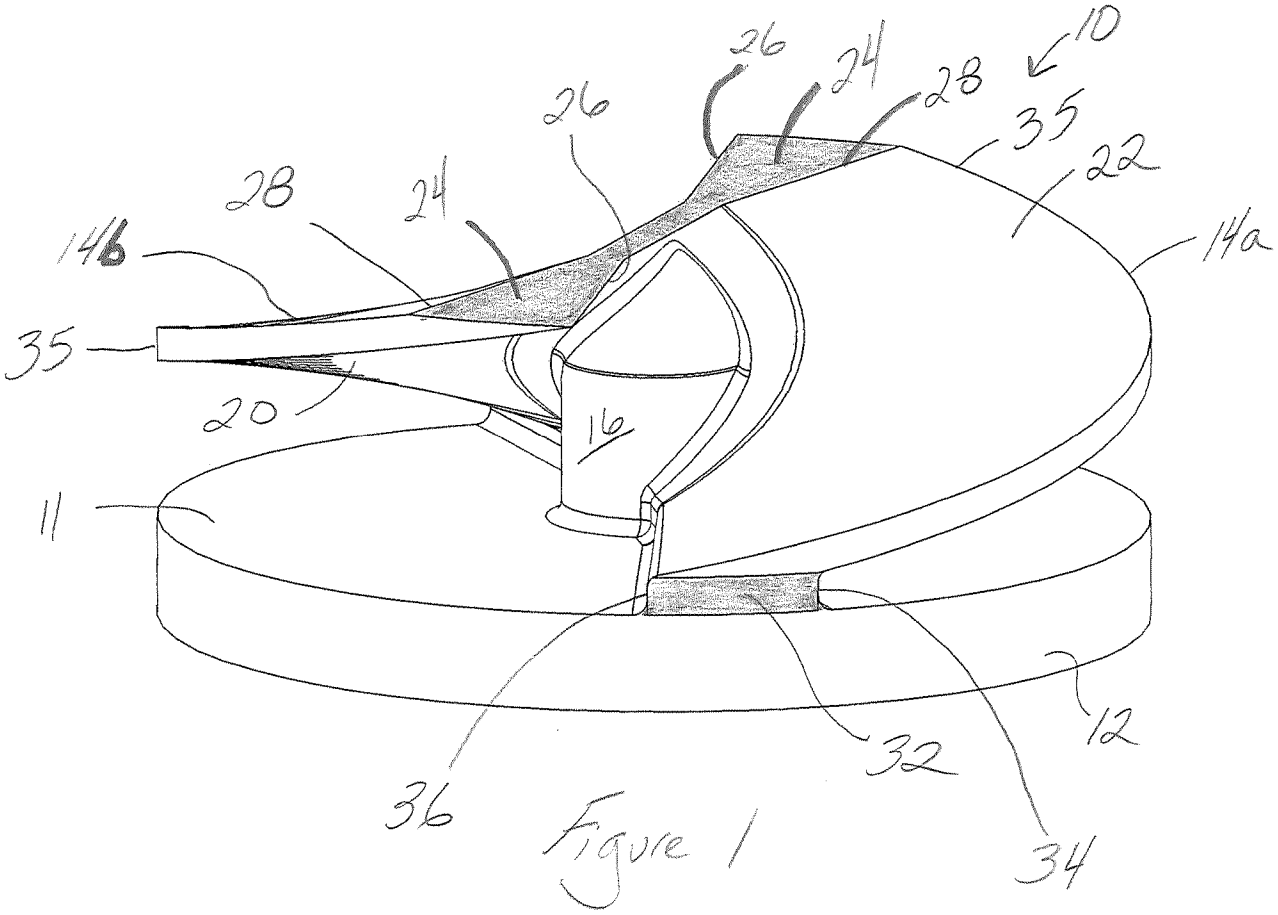
FIG. 1 illustrates an isometric view of an embodiment of the inlet side of an impeller.

The following reference characters are used in the specification and figures:

| | |
|---|---|
| 10 | Impeller |
| 11 | Front side |
| 12 | Shroud |
| 13 | Backside |
| 14a, b | Vane(s) |
| 16 | Hub |
| 17 | Orifice |
| 18 | Impeller axis |
| 19 | Hub protrusion |
| 20 | High pressure surface |
| 22 | Low pressure surface |
| 24 | Upper vane surface |
| 26 | Leading edge |
| 28 | Trailing edge |
| 30 | Lower leading edge |
| 31 | Lower trailing edge |
| 32 | Lower vane body |
| 33 | Central axis |
| 34 | Lower leading surface |
| 35 | Vane edge |
| 36 | Lower trailing surface |
| 37 | Casing |
| 38 | Inlet orifice |
| 40 | Sidewall |
| 42 | Front wall |
| 43 | Inlet port |
| 44 | Cavity |
| 45 | External thread |
| 46 | Discharge port |
| 48 | Outlet orifice |

DETAILED DESCRIPTION OF THE INVENTION

Figure 2:
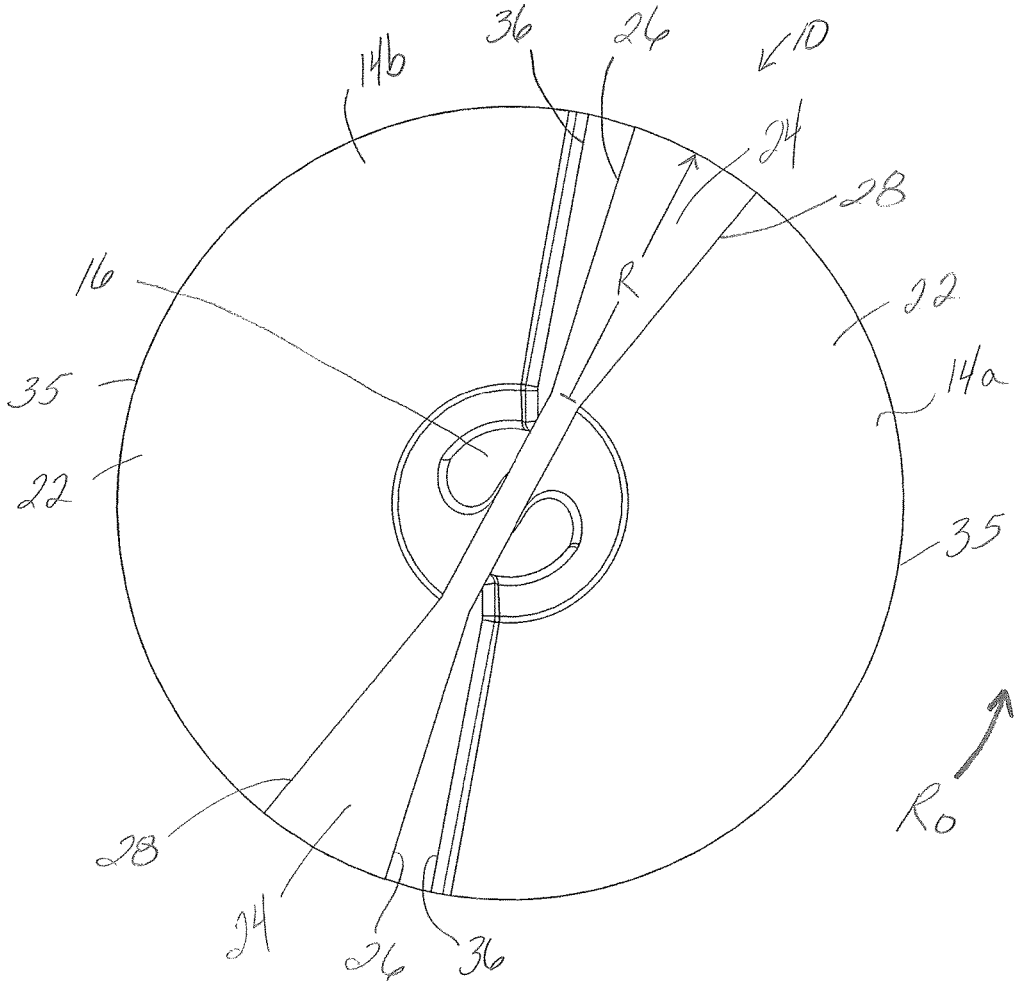
FIG. 2 illustrates an inlet side view of the impeller shown in FIG. 1.

FIGS. 1-5 illustrate an embodiment of an impeller 10 according to the present disclosure. In the illustrated embodiment, the impeller 10 is a radial impeller that includes a shroud 12, at least two vanes 14*a*, 14*b*, and a generally central hub 16. According to certain embodiments, vanes 14*a*, 14*b* and the shroud 12 may be part of a single, integral construction. The hub 16 may extend from a front side 11 of the shroud 12 and be positioned along an impeller axis 18. Further, the hub 16 may have a variety of different configurations, including, for example, being generally cylindrical. Additionally, according to certain embodiments, the shroud 12 and/or hub 16 may be configured to be operably connected to a drive shaft, such as, for example, to an impeller shaft that is used to rotate the impeller 10 about the impeller axis 18. For example, the impeller shaft may be used to rotate the impeller 10 in a circumferential rotation direction $R_o$, as indicated in FIG. 2.

Figure 4:
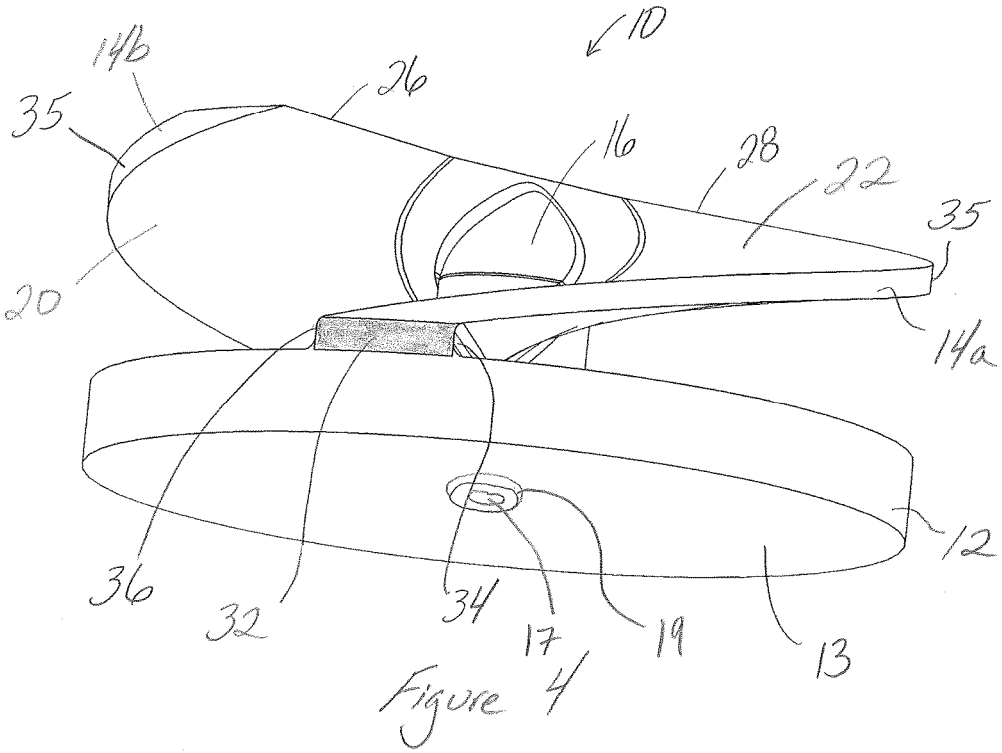
FIG. 4 illustrates an isometric view of the impeller shown in FIG. 1.
Figure 5:
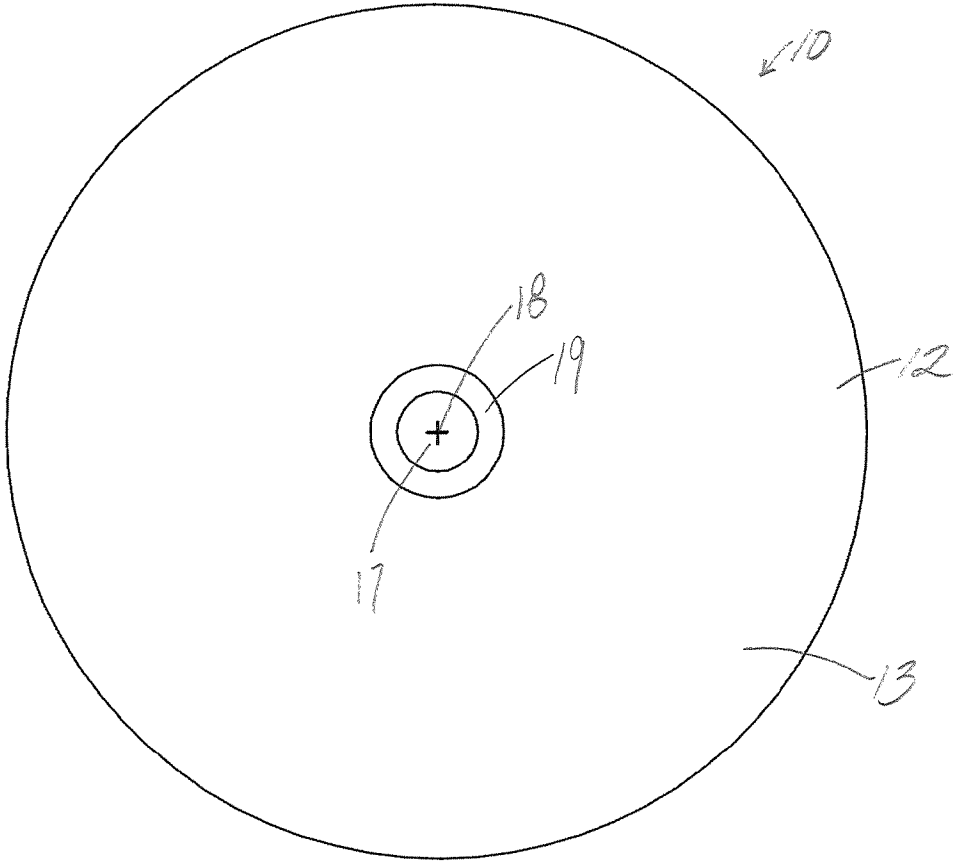
FIG. 5 illustrates a rear view of an impeller according to an illustrated embodiment.

Referencing at least FIGS. 4 and 5, the impeller 10 may include an orifice 17 that is configured for connecting the impeller 10 the impeller shaft. For example, according to certain embodiments, the orifice 17 may include an internal thread that is configured for a threaded connection with an external thread of the impeller shaft or a coupling used to connect the impeller 10 to the impeller shaft. Alternatively, the orifice 17 may be sized to receive a portion of the impeller shaft and may include one or more slots that are configured for a keyed connection between the impeller 10 and the impeller shaft.

Further, according to certain embodiments, the orifice 17 may pass through a hub protrusion 19 that extends outwardly from a backside 13 of shroud 12, the backside 13 being on a side of the shroud 12 that is opposite of the front side 11 (i.e., the side containing vanes 14*a*, 14*b*). According to certain embodiments, the hub protrusion 19 may be sized to space at least a portion of the shroud 12 from an adjacent wall of a casing. Further, according to certain embodiments, the hub protrusion 19 may be sized to receive a set screw that is used to at least assist in securing the impeller 10 to the impeller shaft. For example, the hub protrusion can be about 0.01" to about 0.1", such as about 0.03".

In the illustrated embodiment, the impeller 10 has two vanes 14*a*, 14*b* that extend radially outwardly from the hub 16. Moreover, the two vanes 14*a*, 14*b* extend from two locations that are spaced equidistantly around the circumference of the hub 16. While other embodiments of the impeller 10 may utilize more than two vanes 14*a*, 14*b*, a two vane 14*a*, 14*b* configuration may enhance the overall hydraulic balance of the impeller 10.

Figure 3A:
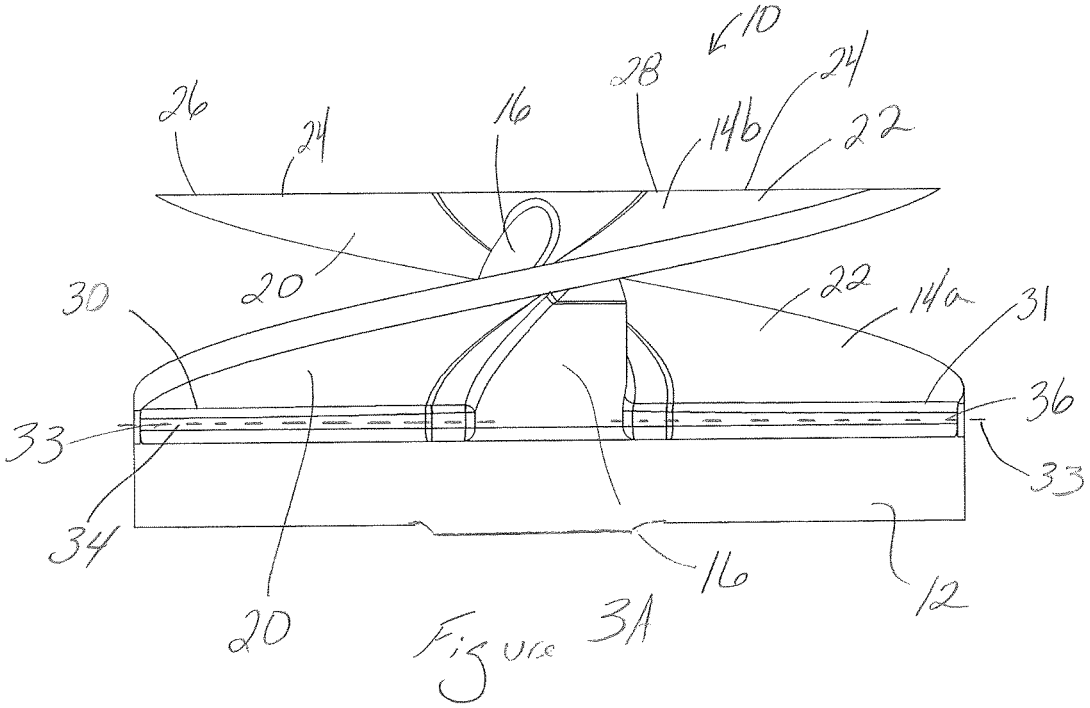
FIGS. 3A and 3B illustrate side elevation views of the impeller shown in FIG. 1.
Figure 3B:
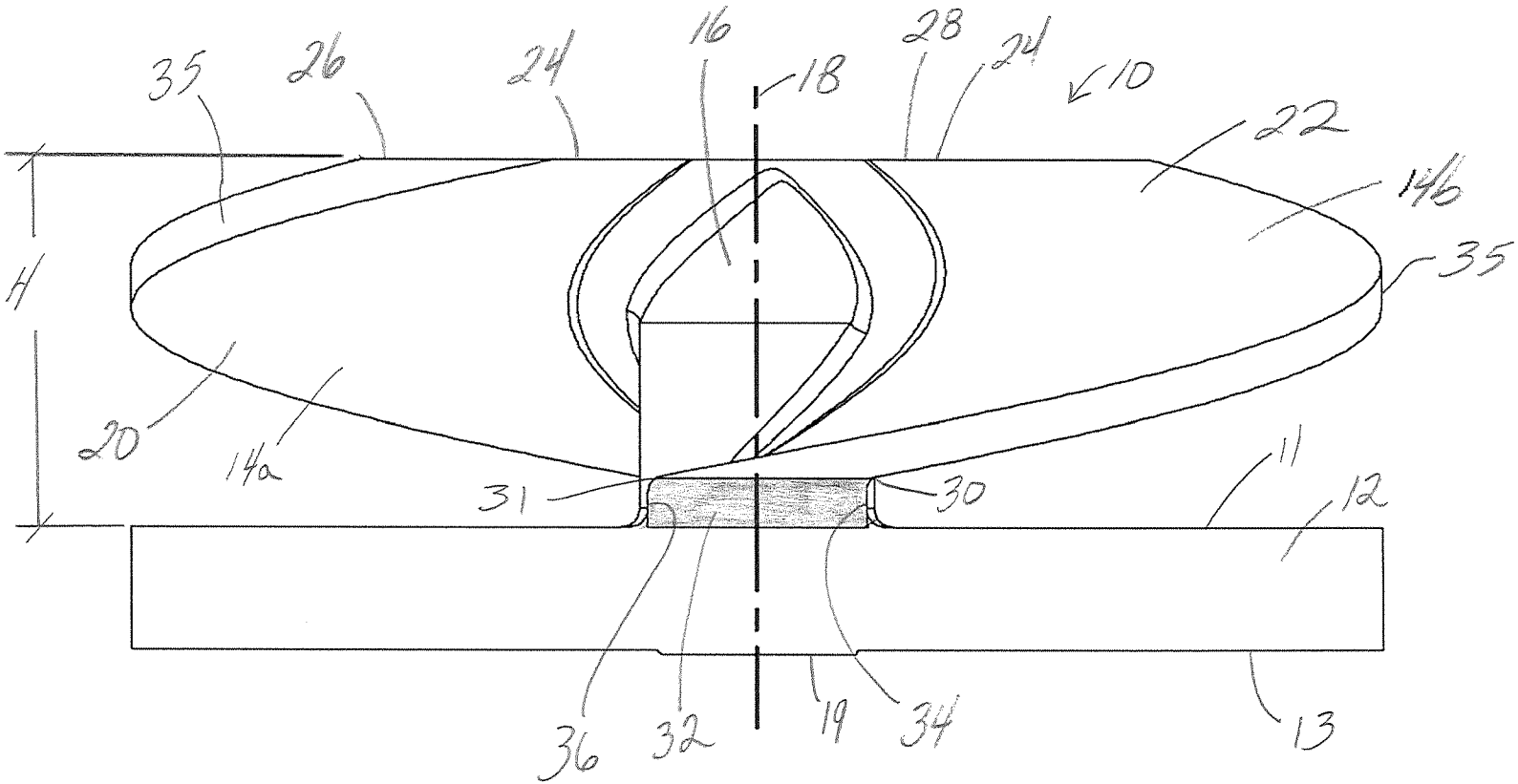
Figure 7:
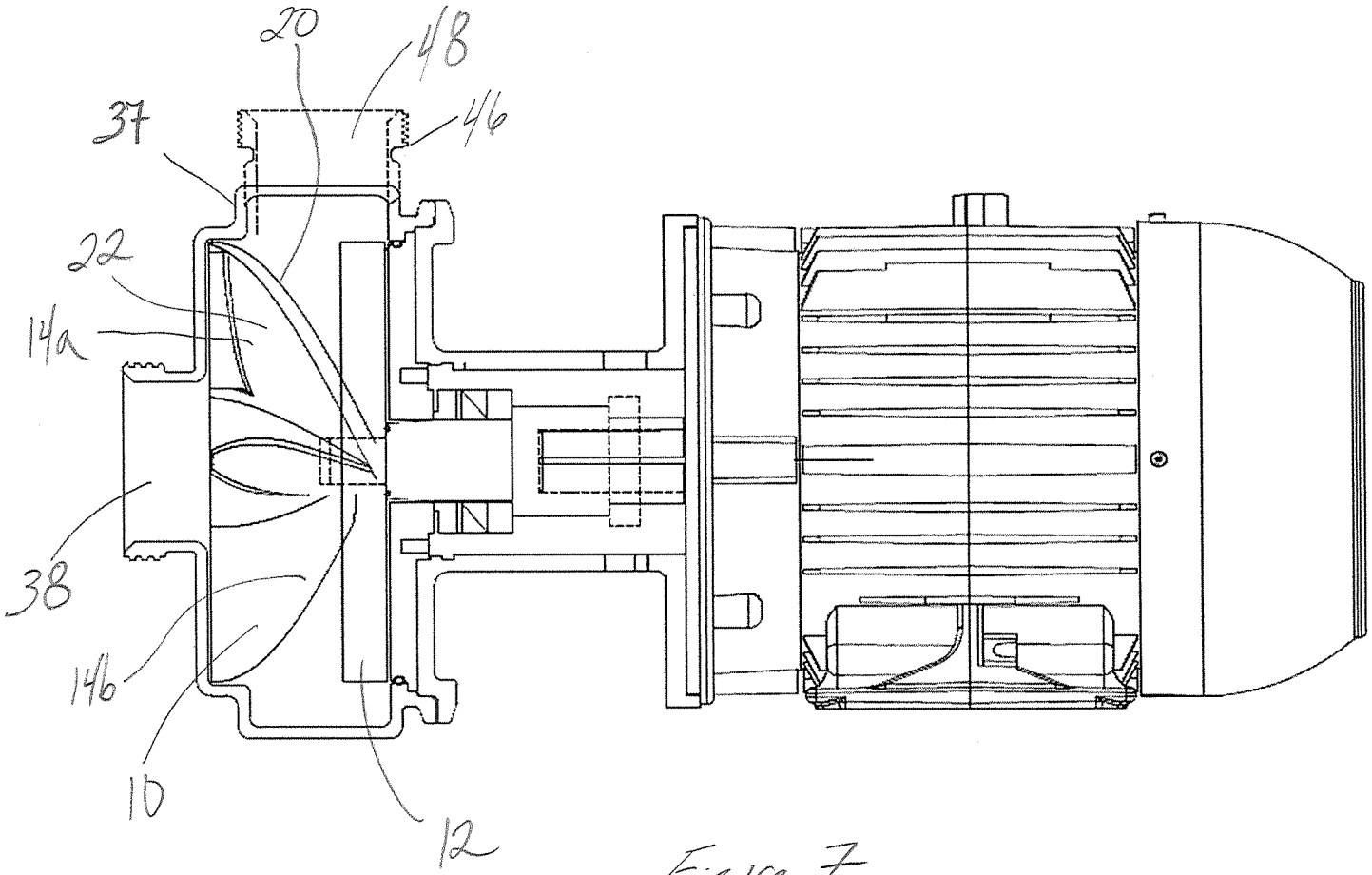
FIG. 7 illustrates a partial cross sectional view of an impeller assembly having an impeller, casing, and a motor according to an illustrated embodiment.

Each vane 14*a*, 14*b* defines a high pressure surface 20 and a low pressure surface 22. As best shown by FIGS. 2, 3B, and 7, when positioned within a casing 37, the low pressure surface 22 faces partially outwardly along the impeller axis 18 toward an inlet orifice 38 of the casing 37. Conversely, the high pressure surface 20 faces partially along the impeller axis 18 away from the inlet orifice 38. Further, each vane 14*a*, 14*b* has an upper vane surface 24 that lies in a plane that is generally perpendicular to the impeller axis 18. The upper vane surface 24 meets the high pressure surface 20 along a leading edge 26. Additionally, the upper vane surface 24 meets the low pressure surface 22 along a trailing edge 28.

According to certain embodiments, each vane 14*a*, 14*b* extends along the hub 16 to a lower vane body 32. According to the illustrated embodiment, the lower vane body 32 may extend along the front side 11 of the shroud 12. Further, the lower vane body 32 may extend along the front side 11 of the shroud 12 about a central axis 33 that generally lies in a plane that is perpendicular to the impeller axis 18. The lower vane body 32 may also include a lower leading surface 34 and a lower trailing surface 36. The lower leading surface 34 may generally meet the high pressure surface 20 at a lower leading edge 30. The lower trailing surface 36 may generally meet the low pressure surface 22 at a lower trailing edge 31.

Each vane 14*a*, 14*b* extends along the hub 16 from the upper vane surface 24 to the lower vane body 32 and sweeps an arc around the hub 16 in a circumferential direction from the leading edge 26 toward the trailing edge 28 that is opposite the circumferential rotation direction $R_o$. The vane 14*a*, 14*b* may sweep an arc around the impeller axis 18 so that the cord length for the leading edge 26 of the upper vane surface 24 to the lower trailing edge 31 achieves a solidity ratio to the vane spacing or pitch of at least 0.46:1.

Figure 6:
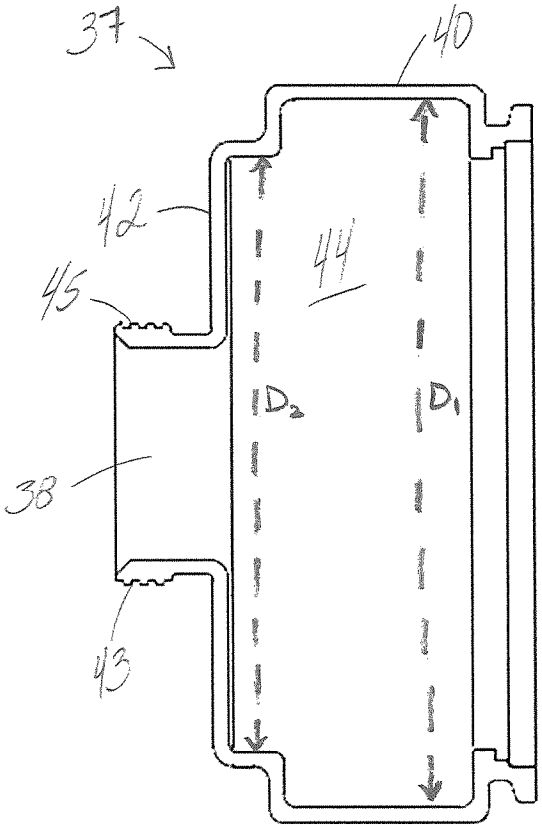
FIG. 6 illustrates a side cross sectional view of a casing according to an illustrated embodiment.

FIG. 6 illustrates a cross sectional side view of a casing 37 according to an illustrated embodiment of the present disclosure. The casing 37 includes a sidewall 40 and a front wall 42 that generally define a cavity 44 of the casing 37. The sidewall 40 and front wall 42 may include a variety of recesses, protrusions, and/or shoulders. For example, as shown in FIGS. 6 and 7, the front wall 42 may include an inlet port 43 having an inlet orifice 38 that is in fluid communication with the cavity 44. Similarly, the sidewall 40 may include a discharge port 46 having an outlet orifice 48 that is in fluid communication with the cavity 44. The inlet port 43 may be configured for an operable connection to a supply line that is used in the delivery of fluid and/or solids to the inlet orifice 38. Similarly, the discharge port 46 may be configured for an operable connection with a discharge line that receives fluids and/or solid that is exiting the casing 37. For example, according to certain embodiments, the inlet and discharge ports 43, 46 may be configured for mechanical connection with the supply or discharge lines, respectively, such as a clamped, threaded, or compression engagement, among other connections. In the illustrated embodiment, the inlet and discharge ports 43, 46 each include an external thread 45 that is configured for an operable connection with the associated supply or discharge line or associated couplings or connector(s). However, the inlet and discharge ports 43, 46 may be configured for a variety of other connections with the associated supply or discharge lines, including, for example, welded or soldered connections, among others.

Referencing FIG. 3B, according to certain embodiments, the height ("H") of the impeller 10 between the upper vane surface 24 and the front side 11 of the shroud 12 is generally equal to the diameter of the outlet orifice 48 of the discharge port 46. The arc swept by the vane 14*a*, 14*b* (from upper vane surface 24 along the impeller axis to the lower vane body 32) extends the high pressure surface 20 extends the acceleration distance and thereby decreases the shear forces applied to fluid moved by the impeller 10 to diminish damage that such forces may cause. The sweep of the vane 14*a*, 14*b* and ratio of the swept arc to impeller height provides relatively gentle re-direction of the liquid and/or solids in the cavity 44 of the casing 37, thereby reducing abrupt changes in direction for the liquid and/or solids being moved within the cavity 44 and increases overall pump efficiency.

As shown by at least the leading edge 26 and trailing edge 28 as illustrated in FIG. 2, each vane 14*a*, 14*b* may be formed so that the distance between the high pressure surface 20 and the low pressure surface 22 increases as the distance away from the hub 16 increases to a distance R. By increasing the distance between the leading and trailing edges 26, 28 as the distance away from the hub 16 increases, the length of a slip path along the high pressure surface 20 in a direction from the hub 16 toward the vane edge 35 may also be increased. The longer slip path may decrease the amount of fluid and/or solids that can travel over the high pressure surface 20 to and around the vane edge 35 to the low pressure surface 22, thereby reducing recirculation of fluid and/or solids around the impeller 10 and increasing pumping efficiency.

Reducing recirculation around the vane edge 35 reduces the chances of damaging any fluid and solids entrained in the fluid. The wide slip path on vane surfaces 22 and 24 makes the transit of the liquid from the high pressure side of the impeller to the low pressure side difficult. A tight mechanical tolerance between the pump casing and the upper vane surface 42 makes this design highly efficient as it reduces the liquids ability to recirculate inside the pump. In addition to the wide area of the slip path, the integral rear shroud limits recirculation from the high pressure to low pressure thus eliminating the liquids ability to recirculate at the back of the impeller, further improving the efficiency of the pump.

As shown in at least FIG. 7, when positioned in the casing 37, the shroud 12 is positioned axially behind the vanes 14*a*, 14*b*. Further, the shroud 12 has generally the same or similar outer diameter as the impeller 10. More specifically, the shroud 12 has a radius from the impeller axis 18 that is similar to the distance from the impeller axis 18 to the vane edge 35. The thickness of the integral shroud, as a ratio of the impeller height, is determined to be about 0.337. The shroud serves to offset the impeller axially away from the back of the casing and, more particularly, forward from the casing discharge port.

The front of the casing consists of two concentric radii from the central axis. The major diameter $D_1$ is axially rearward and of sufficient size beyond the impeller diameter to facilitate efficient transfer from kinetic to potential energy, as understood in the art. The height of the major diameter is equal to the diameter of the outlet port. The minor diameter $D_2$ is axially forward and is the same diameter as the impeller plus that which is necessary for mechanical clearance (e.g., the minimum clearance between a vane edge of the impeller and the casing at the minor diameter is about 0.02"). The height of the minor diameter is equivalent to that of the impeller shroud. The transition from minor to major casing diameter is stepped such that there is a 90° angle from the major diameter to a transition step that is perpendicular to the axis and a 90° angle from the transition step to the minor diameter. This stepped casing provides a narrowing fluid channel from the axial front to the axial rear as the fluid translates from the impeller hub to the impeller periphery. This channel provides a smooth and efficient path while limiting recirculation and therefore improving pump efficiency, both of which result in lower fluid and solids damage.

The impeller described in this disclosure provides a centrifugal impeller and casing which can pump shear sensitive and high solids liquids with high efficiencies and low product damage. The helical vane sweep induces laminar flow. The impeller vanes, shroud, and casing reduce recirculation and assist inducement of laminar flow, therefore requiring less power.

One metric used in the dairy industry to measure the quality of milk is the acid degree value ("ADV"). The ADV measures the presence of long chain fatty acids in the milk. There is a correlation between the ADV and the flavor of milk because rancidity results from the release of free fatty acids in the milk. When used in dairy processing applications, conventional pumps typically produce an undesirable increase in the ADV of the milk as a result of fat globule damage due to mechanical shearing. This increase in the ADV can negatively affect the taste of the milk. In contrast, when a pump employing the claimed impeller and casing is used to pump milk, there is either no significant change in the ADV level as a result of pumping or even a decrease in the ADV level. This advantageous result reflects that pumps employing the claimed impeller and casing cause less product damage due to mechanical shearing than conventional systems.

This beneficial result was confirmed by two independent tests, the results of which are summarized in the working examples and Tables 1 and 2 below.

Example 1: Tests Performed by Silliker, Inc

The ADV levels of various milk samples were measured before pumping and after pumping using a pump employing the claimed impeller and casing—namely, the Bowpeller model B3258 8" centrifugal pump—in Trials A and B and a competitor's conventional 8" centrifugal pump in Trials C and D. The results, summarized in Table 1, show that in Trials C and D, the ADV of the milk consistently increased as a result of pumping using the competitor's conventional pump, thereby indicating undesirable mechanical agitation and foaming of the milk due to pumping. However, Trials A and B show that the ADV of the milk consistently decreased (or at least did not change) as a result of pumping using the claimed impeller and casing—a highly desirable outcome.

Example 2: Tests Performed by Eurofins DQCI LLC

The ADV levels of various milk samples were measured before pumping and after pumping using a pump employing the claimed impeller and casing—namely, the Bowpeller model B15154 4" centrifugal pump—in Trials E and F and a competitor's conventional 4" centrifugal pump in Trials G and H. The results, summarized in Table 2, show that in Trials G and H, the ADV of the milk consistently increased as a result of pumping using the competitor's conventional pump, thereby indicating undesirable mechanical agitation and foaming of the milk due to pumping. However, Trials E and F show that the ADV of the milk consistently decreased (or at least did not change) as a result of pumping using the claimed impeller and casing—a highly desirable outcome.

This data confirms that a pump employing the claimed impeller and casing is capable of pumping shear sensitive liquids (such as milk) without applying damaging forces to the liquid. This result would also have beneficial application in food processing systems, pharmaceutical processing systems, and clay slurries.

TABLE 1

Tests Performed by Silliker, Inc.

| Pump | Acid Degree Value (Dairy Tank; Before Pumping) | Acid Degree Value (Truck Tanker; After Pumping) | Change in Acid Degree Value Due to Pumping |
|---|---|---|---|
| Applicant Trial A | 0.98 | 0.97 | −0.01 |
| Applicant Trial B | 0.99 | 0.95 | −0.04 |
| Competitor Trial C | 0.90 | 0.94 | +0.04 |
| Competitor Trial D | 0.86 | 0.94 | +0.08 |

TABLE 2

Tests Performed by Eurofins DQCI LLC

| Pump | Acid Degree Value (Raw Milk; Before Pumping) | Acid Degree Value (Raw Milk; After Pumping) | Change in Acid Degree Value Due to Pumping |
|---|---|---|---|
| Applicant Trial E | 0.82 | 0.73 | −0.09 |
| Applicant Trial F | 0.82 | 0.69 | −0.13 |
| Competitor Trial G | 0.63 | 0.68 | +0.05 |
| Competitor Trial H | 0.63 | 0.77 | +0.14 |

The present disclosure has been described by reference to certain embodiments, however, it will be understood by those skilled in the art that the described embodiments do not limit the present disclosure and that the disclosure may be practiced other than as by the described embodiments, and encompasses all sizes, configurations, alternatives, modifications, and equivalents within the scope of the appended claims.

We claim:

1. An impeller for a centrifugal pump comprising:

(a) a hub extending along an impeller axis, the impeller axis defining an axial direction along the hub;

(b) at least two vanes having a helical vane sweep and extending from the hub in a radial direction away from the impeller axis to a radial vane edge at the farthest extent of the vane from the hub, each vane extending along the hub in the direction of the impeller axis from a first location to a second location, the direction along the impeller axis from the first location to the second location defining an axial inlet direction;

each vane extending around the hub in a first circumferential direction to sweep an arc from a first location along the impeller axis to a second location along the impeller axis;

each vane defining:

a high pressure surface facing at least partially along the axial inlet direction, the high pressure surface extending from a high pressure surface leading edge at the first location in the axial inlet direction in the first circumferential direction to a high pressure surface trailing edge at the second location, the high pressure surface leading edge and the high pressure surface trailing edge extending outwardly from the hub away from the impeller axis, a low pressure surface facing at least partially along the impeller axis in a second axial direction that is opposite the axial inlet direction, the low pressure surface separated from the high pressure surface in the first circumferential direction, the separation between the high pressure surface and the low pressure surface in the first circumferential direction increasing with distance from the impeller axis to a first location closely adjacent to the radial vane edge;

and (c) a full circular shroud of a diameter equal to that of the impeller that is oriented and integral to the axial rear of the impeller, wherein the shroud comprises a front side;

wherein the ratio of the depth of the shroud to the impeller vane axial height is about 0.337:1, wherein the impeller vane axial height is the distance between a first plane defined by the first location to a second plane defined by the second location, the first and second planes each perpendicular to the impeller axis;

wherein each vane extends along the hub to a lower vane body, the lower vane body extending along the front side of the shroud about a central axis that lies in a plane that is perpendicular to the impeller axis; and wherein the lower vane body of each vane includes a lower leading surface and a lower trailing surface, the lower leading surface meeting the high pressure surface at a lower leading edge and the lower trailing surface meeting the low pressure surface at a lower trailing edge.

2. The impeller of claim 1 wherein the vanes define an upper vane surface containing the first location and extending from the high pressure surface leading edge to meet the low pressure surface to form an upper vane surface trailing edge.

3. The impeller of claim 2 wherein the high pressure surface leading edge and the lower vane surface trailing edge of each vane define a generally straight line extending radially away from the impeller axis and each vane sweeps an arc around the impeller axis so that cord length from the high pressure surface leading edge at the first location in the axial inlet direction in the first circumferential direction to the lower vane surface trailing edge at the second location of the axial outlet achieves a ratio to the vane spacing of at least 0.46:1.

4. A centrifugal pump comprising
the impeller of claim 1; and
a pump casing, the pump casing comprising
a casing discharge port,
a casing inlet port, and
a cavity that provides for fluid communication between the casing discharge port and the casing inlet port and containing the impeller of claim 1, the cavity defined by a major diameter and a minor diameter, wherein,
the major diameter is centrally concentric to the minor diameter and both diameters are centrally concentric to the impeller axis,
the major diameter is positioned directly behind the minor diameter and separated by a step that is perpendicular to the impeller axis;
the depth of the major diameter is essentially equivalent to the outlet diameter;
the minor diameter is essentially the diameter of the impeller plus the clearance necessary to prevent mechanical interference, and
the depth of the minor diameter is as necessary to accept the balance of the impeller's height.

5. The centrifugal pump of claim 4, wherein the placement of the impeller of claim 1 within the casing is such that the axial rear of the impeller shroud is positioned in alignment with the axial rear of the internal diameter of the casing discharge port.

6. A centrifugal pump comprising the impeller of claim 1 and a pump casing.

7. A centrifugal pump comprising the impeller of claim 2 and a pump casing.

8. A centrifugal pump comprising the impeller of claim 3 and a pump casing.

9. A method for pumping shear sensitive liquids or liquids having suspended solids comprising:
a. providing the centrifugal pump of claim 4,
b. providing a liquid to be pumped at the casing inlet port, and
c. rotating the impeller to pump the liquid from the casing inlet port to the casing discharge port.

10. The impeller of claim 1 wherein the ratio of the depth of the shroud to the impeller vane axial height is 0.337:1.

11. A centrifugal pump comprising
the impeller of claim 10; and
a pump casing, the pump casing comprising
a casing discharge port,
a casing inlet port, and
a cavity that provides for fluid communication between the casing discharge port and the casing inlet port and containing the impeller of claim 10, the cavity defined by a major diameter and a minor diameter, wherein,
the major diameter is centrally concentric to the minor diameter and both diameters are centrally concentric to the impeller axis,
the major diameter is positioned directly behind the minor diameter and separated by a step that is perpendicular to the impeller axis;
the depth of the major diameter is essentially equivalent to the outlet diameter;
the minor diameter is essentially the diameter of the impeller plus the clearance necessary to prevent mechanical interference, and
the depth of the minor diameter is as necessary to accept the balance of the impeller's height.

12. A method for pumping shear sensitive liquids or liquids having suspended solids comprising:
a. providing the centrifugal pump of claim 5,
b. providing a liquid to be pumped at the casing inlet port, and
c. rotating the impeller to pump the liquid from the casing inlet port to the casing discharge port.

13. A method for pumping shear sensitive liquids or liquids having suspended solids comprising:
a. providing the centrifugal pump of claim 6,
b. providing a liquid to be pumped at an inlet to the pump casing, and
c. rotating the impeller to pump the liquid from the inlet to an outlet to the pump casing.

14. A method for pumping shear sensitive liquids or liquids having suspended solids comprising:
a. providing the centrifugal pump of claim 7,
b. providing a liquid to be pumped at an inlet to the pump casing, and
c. rotating the impeller to pump the liquid from the inlet to an outlet to the pump casing.

15. A method for pumping shear sensitive liquids or liquids having suspended solids comprising:
a. providing the centrifugal pump of claim 8,
b. providing a liquid to be pumped at an inlet to the pump casing, and
c. rotating the impeller to pump the liquid from the inlet to an outlet to the pump casing.

16. A method for pumping shear sensitive liquids or liquids having suspended solids comprising:
a. providing the centrifugal pump of claim 11,
b. providing a liquid to be pumped at the casing inlet port, and
c. rotating the impeller to pump the liquid from the casing inlet port to the casing discharge port.

* * * * *